United States Patent [19]

Tadewald

[11] 4,152,304

[45] May 1, 1979

[54] PRESSURE-SENSITIVE FLEXIBLE RESISTORS

[75] Inventor: Thomas D. Tadewald, La Crosee, Wis.

[73] Assignee: Universal Oil Products Company, Des Plaines, Ill.

[21] Appl. No.: 547,689

[22] Filed: Feb. 6, 1975

[51] Int. Cl.[2] ..... H01B 1/06

[52] U.S. Cl. ..... 252/506; 252/508; 252/511; 338/114

[58] Field of Search ..... 252/502, 506, 508, 511; 338/114, 99, 104

[56] References Cited

U.S. PATENT DOCUMENTS

| | | | |
|---|---|---|---|
| 3,295,088 | 12/1966 | Smith | 338/114 |
| 3,419,702 | 12/1968 | Piel | 338/114 |
| 3,651,386 | 3/1972 | Youtsey et al. | 252/506 X |
| 3,947,278 | 3/1976 | Youtsey | 252/511 |
| 4,018,943 | 4/1977 | Youtsey et al. | 252/506 X |
| 4,054,540 | 10/1977 | Michalchik | 338/114 X |

FOREIGN PATENT DOCUMENTS

| | | | |
|---|---|---|---|
| 2543455 | 4/1976 | Fed. Rep. of Germany | 338/114 |
| 1456997 | 9/1966 | France | 252/508 |
| 243143 | 11/1925 | United Kingdom | 338/114 |

*Primary Examiner*—Benjamin R. Padgett
*Assistant Examiner*—J. L. Barr
*Attorney, Agent, or Firm*—James R. Hoatson, Jr.; Raymond H. Nelson; William H. Page, II

[57] ABSTRACT

Pressure-sensitive flexible resistors comprising an elastomeric material containing a controlled resistive element or material are prepared by impregnating an elastomeric material such as a rubber with a semiconducting carbonaceous pyropolymeric inorganic refractory oxide material.

6 Claims, No Drawings

PRESSURE-SENSITIVE FLEXIBLE RESISTORS

This invention relates to elastomeric materials containing a semiconducting carbonaceous pyropolymeric inorganic refractory oxide material. More specifically, the invention is concerned with a composition of matter which may be used as a pressure-sensitive flexible resistor comprising an elastomeric material impregnated with a semiconducting carbonaceous pyropolymeric inorganic refractory oxide material.

Heretofore, it has been known that flexible material such as elastomers which contain a material conductive to electricity such as metal particles may be used for various applications where a change in the configuration of the material due to pressure being applied thereto will conduct a charge of electricity therethrough. For example, when an elastomer contains metal particles embedded therein, the current carrying capacity of the metal particles can be altered when pressure is applied to the elastomer. According to one theory, when a rubber such as a silicone type is used, metal may be added thereto to increase the current carrying capacity, a charge transfer zone being formed within the substrate which surrounds the metal particles. When the substrate is deformed by exertion of pressure thereon, the electrical resistance decreases as the pressure force increases, the resistance remaining constant at each force level. These elastomeric materials containing a conducting material may be utilized in many ways. For example, the elastomer may be used to form a mat or pad, the resulting conductive mat being used in alarm systems to warn or forestall the breaking in of a thief or burglar. Likewise, it is possible to utilize a pressure-sensitive elastomer containing a conductive element for horn rings or brakes whereby the amount of pressure applied to the flexible resistor will control the intensity or sound of the horn noise or brake light. Likewise, it is also possible to utilize the elastomeric material containing the conductive element as a flexible heater, the temperature of the heater being controlled by the amount of pressure which is applied to the elastomer.

Heretofore the conductive elements which were present in the elastomeric material comprised metal or carbon. However, these types of flexible resistors or flexible heaters possessed certain disadvantages. For instance, one problem which is present when utilizing carbon impregnated elastomeric materials is the difficulty in controlling the lower range of resistivities or conductivities. Therefore, in order to control or to obtain a desired conductivity, it was necessary to vary the percentage of the carbon which would be present in the finished elastomeric material. Likewise, a disadvantage which would be present when utilizing metal or metal particles as the conductive element of the flexible resistor or heater would be the cost involved.

In contradistinction to this, it has now been discovered that a pressure-sensitive flexible resistor or controlled temperature flexible heater may be prepared by admixing or impregnating an elastomeric material with a semiconducting carbonaceous pyropolymeric inorganic refractory oxide material of the type hereinafter set forth in greater detail whereby an improved product is obtained which possesses a control resistivity and which may be prepared at a relatively low cost.

It is therefore an object of this invention to provide a controlled pressure-sensitive flexible resistor or controlled temperature flexible heater.

A further object of this invention is to provide a pressure-sensitive flexible resistor or controlled temperature flexible heater by utilizing an elastomeric material with a compound of the type hereinafter set forth in greater detail.

In one aspect an embodiment of this invention resides in a pressure-sensitive flexible resistor comprising an elastomeric material impregnated with a semiconducting carbonaceous pyropolymeric inorganic refractory oxide material.

A specific embodiment of this invention is found in a pressure-sensitive flexible resistor which comprises a silicone rubber impregnated with a semiconducting carbonaceous pyropolymeric inorganic refractory oxide, said oxide having a surface area of from 25 to 500 square meters per gram, the resistivity at room temperature of said semiconducting carbonaceous pyropolymeric inorganic refractory oxide material being in a range of from about $10^{-2}$ to about $10^{8}$ ohm-centimeters.

Other objects and embodiments will be found in the following further detailed description of the present invention.

As hereinbefore set forth, it has now been discovered that pressure-sensitive flexible resistors and/or controlled temperature flexible heaters may be prepared by admixing or impregnating an elastomeric material with a semiconducting carbonaceous pyropolymeric inorganic refractory oxide material. By adding such a material which possesses a known resistivity, it is possible to control the resistivity of the elastomer at normal temperature and pressure and also at increased pressure. The elastomeric material which is utilized to prepare the flexible resistors or heaters will preferably comprise a rubber compound. Some specific examples of the rubber formulations which may be admixed with the semiconducting carbonaceous pyropolymeric inorganic refractory oxide material of a type hereinafter set forth in greater detail will include silicone rubber such as the methyl silicone type, other methyl rubbers, Buna-S, SBR (styrene-butadiene rubber formulation), polymers of butadiene or copolymers thereof with other monomers such as, for example, acrylonitrile, isobutylene, cis-4-polybutadiene, etc., butyl rubbers, ethylene-propylene terpolymers, etc. It is to be understood that the aforementioned types of elastomers are only representative of the class of elastomeric materials which may be used, and that the present invention is not necessarily limited thereto.

The semiconducting carbonaceous pyropolymeric inorganic refractory oxide material may comprise at least a monolayer of a carbonaceous pyropolymer containing recurring carbon and hydrogen units which are formed throughout the porous surface of a refractory oxide material. The semiconducting carbonaceous pyropolymeric inorganic refractory oxide material may be prepared by heating an organic compound in the absence of oxygen and passing the pyrolyzable substance over the refractory oxide material in the vapor phase to deposit a carbonaceous pyropolymer thereon. The refractory oxide material which may be used as the base may be in any form such as loose or compacted dry powders, cast or calcined sols, heated sols, substrates in the form of flats, cylinders, and spheres, rods, pellets, etc. In the preferred embodiment of the present invention the refractory oxide base will be characterized as having a surface area of from 25 to about 500 square meters per gram. Illustrative examples of the refractory oxides which may be used will include alumina in various forms such as gamma-alumina, silica, silica-alumina, etc. In addition, it is also contemplated within the scope of the invention that the refractory oxide may be preimpregnated with a catalytic metallic substance such as platinum, platinum and rhenium, platinum and germanium, platinum and tin, platinum and lead, nickel and rhenium, tin, lead, germanium, etc.

Examples of organic substances which may be pyrolyzed to form the pyropolymer on the surface of the aforementioned refractory oxides will include aliphatic hydrocarbons, cycloaliphatic hydrocarbons, aromatic hydrocarbons, aliphatic halogen derivatives, aliphatic oxygen derivatives, aliphatic sulfur derivatives, aliphatic nitrogen derivatives, heterocyclic compounds, organometallic compounds, etc. Some specific examples of these organic compounds which may be pyrolyzed will include ethane, propane, butane, pentane, ethylene, propylene, 1-butene, 2-butene, 1-pentene, 2-pentene, 1,3-butadiene, isoprene, cyclopentane, cyclohexane, methylcyclopentane, benzene, toluene, the isomeric xylenes, naphthalene, anthracene, chloromethane, bromomethane, chloroethane, bromoethane, chloropropane, bromopropane, iodopropane, chlorobutane, bromobutane, iodobutane, carbon tetrachloride, chloroform, 1,2-dichloroethane, 1,2-dichloropropane, 1,2-dichlorobutane, ethyl alcohol, n-propyl alcohol, isopropyl alcohol, n-butyl alcohol, sec-butyl alcohol, t-butyl alcohol, glycol, glycerol, ethyl ether, isopropyl ether, butyl ether, ethyl mercaptan, n-propyl mercaptan, butyl mercaptan, methyl sulfide, ethyl sulfide, ethyl methyl sulfide, methyl propyl sulfide, dimethyl amine, diethyl amine, ethyl methyl amine, acetamide, propionamide, nitroethane, 1-nitropropane, 1-nitrobutane, acetonitrile, propionitrile, formic acid, acetic acid, oxalic acid, acrylic acid, formaldehyde, acid aldehyde, propionaldehyde, acetone, methyl ethyl ketone, methyl propyl ketone, ethyl propyl ketone, methyl formate, ethyl formate, ethyl acetate, benzyl chloride, phenol, o-cresol, benzyl alcohol, hydroquinone, resorcinol, catechol, anisole, phenetole, benzaldehyde, acetophenone, benzophenone, benzoquinone, benzoic acid, phenyl acetate acid, hydrocinnamic acid, furan, furfural, pyran, coumarin, indole, carbohydrate derivatives such as sugars including dextrose, fructose, sucrose starches, etc. It is to be understood that the aforementioned compounds are only representative of the class of compounds which may undergo pyropolymerization and that the present invention is not necessarily limited thereto.

The semiconducting carbonaceous pyropolymeric inorganic refractory oxide material which, as hereinbefore set forth, comprises at least a monolayer of a carbonaceous pyropolymer consisting of recurring carbon and hydrogen units formed on the surface of a high surface area inorganic refractory oxide support, said material having a resistivity at room temperature in the range of from $10^8$ to about $10^{-2}$ ohm-centimeters, may be prepared by heating an organic compound of the type hereinbefore set forth in the absence of oxygen and passing the pyrolyzable substance over the refractory oxide material in the vapor phase to deposit the aforesaid carbonaceous pyropolymer thereon. In one embodiment of the preparation, the aforementioned organic compounds are mixed with a carrier gas such as nitrogen or other inert gases, heated and passed over the refractory oxide base. The deposition of the carbonaceous pyropolymer on the surface of the base is effected at relatively high temperatures ranging from about 400° to above 900° C. and preferably in a range of from about 750° to 900° C. It is possible to govern the electrical properties of the semiconducting carbonaceous pyropolymeric inorganic refractory oxide material by regulating the temperature and residence time during which the refractory oxide base is subjected to the treatment with the organic pyrolyzable substance. The semiconducting pyropolymeric inorganic refractory oxide material which is recovered from the process will possess a resistivity in the range of from about $10^8$ to about $10^0$ ohm-centimeters. However, if so desired, the material may also be subjected to additional exposure to elevated temperatures ranging from about 500° to about 1200° C. in an inert atmosphere and in the absence of additional pyrolyzable materials for various periods of time, said treatment resulting in the reduction of the electrical resistivity of the powders by as much as six orders of magnitude. Therefore, it is possible to obtain resistivities within a predetermined range, thereby controlling the resistivity of the finished elastomeric material containing the conducting material within a narrow range. In another embodiment the semiconducting carbonaceous pyropolymeric inorganic refractory oxide material may be prepared in a different manner. For example, another method which may be employed is to impregnate the refractory oxide material of the type hereinbefore set forth in greater detail with an aqueous solution of a carbohydrate material such as dextrose, sucrose, starch, etc., thereafter drying the impregnated inorganic refractory oxide material and thereafter pyrolyzing said impregnated inorganic refractory oxide material at temperatures ranging from about 700° to about 1200° C. whereby the carbohydrate material is pyrolyzed to form at least a monolayer of the carbonaceous material on the surface of the refractory inorganic oxide material. As in the first mode of preparation previously discussed, the resulting semiconducting carbonaceous pyropolymeric inorganic refractory oxide material may then be subjected to a second heating step at temperatures within the range hereinbefore set forth, the resistivity of the material may be altered to reach a predetermined level, said resistivity also being in a range of from about $10^{-8}$ to about $10^{-2}$ ohm-centimeters.

The thus prepared semiconducting carbonaceous pyropolymeric inorganic refractory oxide material may then be subjected to means for obtaining the desired particle size. Generally speaking, the semiconducting carbonaceous pyropolymeric inorganic refractory oxide material should possess a particle size of less than 20 microns and preferably particles of a size of less than 10 microns are desirable. Alternatively speaking, if so desired, the inorganic refractory oxide material which is used as the base may be ground by conventional means such as ball milling, etc., to the desired particle size prior to treatment with the pyrolyzable substance.

The pressure-sensitive flexible resistors of the present invention may be prepared by any manner known in the art. As an illustration of one method of preparation, an elastomeric material such as rubber is admixed with the semiconducting carbonaceous pyropolymeric inorganic refractory oxide material which possesses a specific resistivity by any means known in the art, such means including admixing, milling together in a ball mill, etc. In the preferred embodiment of the invention the semiconducting carbonaceous pyropolymeric inorganic refractory oxide material is usually present in the elastomeric material in an amount in the range of from about 5 to about 100 parts of resistive material per 100 parts of elastomeric material. The mixture of elastomeric material and conductive material is then placed in a mold for molding into a desired shape and allowed to cure at a predetermined temperature. For example, it is possible to allow the curing of the elastomer to take place at ambient temperature. It is also contemplated within the scope of this invention that the curing may be effected at elevated temperature thereby shortening or reducing the period of time which is ordinarily necessary to effect the curing whereby the elastomeric material will assume the predetermined shape or form and remain in said shape or form.

As an alternate method of preparing the pressure-sensitive flexible resistor or flexible heater of the present invention, a continuous method of operation may be used. When such an operation is used, the elastomeric material and conductive material, which may be in any form and preferably in the form of a powder having an average particle size of about 1 to about 10 microns, are continuously charged to an admixing apparatus where, after being thoroughly admixed, the resulting mixture is continuously charged to a form wherein the mixture will undergo curing, preferably at elevated temperatures, and thereafter be continuously discharged and recovered.

The following examples are given for purposes of illustrating the method of preparing pressure-sensitive flexible resistors or flexible heaters. However, it is to be understood that these examples are given merely for purposes of illustration, and that the present invention is not necessarily limited thereto.

EXAMPLE I

In this example a pressure-sensitive rubber formulation is prepared by admixing 50 grams of a two-component, room temperature vulcanizing rubber which possessed a viscosity of 9000 centipoise at 77° F. and a specific gravity of 1.36 at 77° F. with 10 parts per hundred of a semiconducting carbonaceous pyropolymeric inorganic refractory oxide material and 6 grams of a sulfur vulcanizing catalyst. The aforementioned semiconducting carbonaceous pyropolymeric inorganic refractory oxide material was prepared by impregnating dextrose on a gamma-alumina base in a nitrogen atmosphere at a temperature of about 850° C., and thereafter recovering the resultant semiconducting carbonaceous pyropolymeric inorganic refractory oxide material which possessed a resistivity of 0.534 ohm-centimeters. The admixing was done by first mixing the silicone rubber and the semiconducting carbonaceous pyropolymeric inorganic refractory oxide material followed by addition of the catalyst to the mixture and further admixing the three-component system. The resulting system was then poured on a stainless steel mirror finish plate and a second plate of the same type was placed on top of the system. Although curing could take place at room temperature, the system was placed in a drying oven at an elevated temperature of 50° C. for 1 hour to accelerate the curing. After curing, the elastomer was allowed to stand for 24 hours to stabilize before testing for the resistivity of the elastomer.

To test the resistivity, the elastomer was cut into a shape approximately 4" in diameter and 3/32" thick. Following this, the elastomer was placed in a resistivity chamber, the chamber was closed and the elastomer was put under a pressure of less than 100 pounds per square inch. After being under pressure for 1 minute, the resistance of the elastomer was $1.8\times10^6$ ohm-centimeters. The resistance test was repeated three more times at two-week intervals. At the end of two weeks, the resistance was $2.3\times10^5$ ohm-centimeters; at the end of four weeks, the resistance was $2.7\times10^5$ ohm-centimeters; and at the end of six weeks, the resistance was $5.1\times10^5$ ohm-centimeters.

The above test was repeated utilizing a mixture comprising 10 parts per hundred of a semiconducting carbonaceous pyropolymeric inorganic refractory oxide material prepared by passing benzene over a gamma-alumina base in a nitrogen atmosphere which possessed a resistivity of 0.040 ohm-centimeters with 50 grams of a two-component, room temperature silicone rubber and 6/10 of an accelerated sulfur vulcanizing catalyst. The elastomer was prepared by admixing the three components in a manner similar to that set forth above and curing at an elevated temperature of 50° C. in a drying oven for a period of 1 hour. The pressure-sensitive flexible resistor was tested for resistivity also in a manner similar to that set forth in Example I above under a pressure of less than 100 pounds per square inch. The initial reading of the resistivity was $9.1\times10^4$ ohm-centimeters. After two weeks, the resistivity was $6.3\times10^3$ ohm-centimeters; after four weeks, $6.6\times10^3$ ohm-centimeters and after six weeks, $7.2\times10^3$ ohm-centimeters. It is to be noted that due to the low resistivity of the semiconducting carbonaceous pyropolymeric inorganic refractory oxide material, that is, 0.040 ohm-centimeters, it is possible to utilize the flexible resistor as a flexible heat generator at 120 Volts of alternating current.

EXAMPLE II

In a manner similar to that set forth in Example I above, six additional flexible resistors were prepared. The six elastomers contained 10 parts per hundred of a semiconducting carbonaceous pyropolymeric inorganic refractory oxide material, each of which possessed a different resistivity. The initial resistivity of the semiconducting carbonaceous pyropolymeric inorganic refractory oxide material is set forth in Table I below:

TABLE I

| Powder | Resistivity Ohm-Centimeters |
|---|---|
| 1 | 0.545 |
| 2 | 0.190 |
| 3 | 0.424 |
| 4 | 0.160 |
| 5 | 0.394 |
| 6 | 0.125 |

The resistance of the various elastomers prepared from these powders was measured after the elastomer was under a pressure of less than 100 pounds per square inch for 1 minute, said resistivities being measured at an initial period, after two weeks, four weeks, and six weeks respectively. The resistivities of the various elastomers are set forth in Table II below:

TABLE II

| | Resistivity Ohm-centimeters | | | |
|---|---|---|---|---|
| Elastomer | Initial | Two Weeks | Four Weeks | Six Weeks |
| 1 | $6.9\times10^5$ | $3.9\times10^5$ | $6.8\times10^5$ | $6.3\times10^5$ |
| 2 | $9.5\times10^5$ | $1.2\times10^5$ | $2.5\times10^5$ | $2.5\times10^5$ |
| 3 | $1.9\times10^6$ | $4.5\times10^5$ | $7.4\times10^5$ | $2.7\times10^5$ |
| 4 | $2.5\times10^5$ | $5.9\times10^4$ | $1.2\times10^5$ | $1.4\times10^5$ |
| 5 | $5.5\times10^5$ | $1.9\times10^5$ | $1.3\times10^5$ | $8.3\times10^4$ |
| 6 | $1.1\times10^5$ | $2.9\times10^4$ | $6.3\times10^4$ | $4.7\times10^4$ |

It will be noted from the above table that the higher resistivity readings of the elastomer will correspond to the higher resistivity of the semiconducting carbonaceous pyropolymeric inorganic refractory oxide material which was used in the formulation of the flexible resistor and conversely the lower resistivities of the elastomers are found when using a semiconducting carbonaceous pyropolymeric inorganic refractory oxide material which itself possesses a low resistivity. Therefore, it is possible to vary the resistivity of the elastomer without varying the amount of the semiconducting carbonaceous pyropolymeric inorganic refractory oxide material which is added to the system.

EXAMPLE III

In this example a semiconducting carbonaceous pyropolymeric inorganic refractory oxide material is prepared by passing cyclohexane over silica-alumina powder, which has been ground to a particle size which averages 10 microns in a nitrogen atmosphere at a temperature of 800° C. for a period of 2 hours. The resulting semiconducting carbonaceous pyropolymeric inorganic refractory oxide material is recovered and admixed with a Buna-S rubber, 10 parts per hundred of the resistive material being used for each 50 grams of Buna-S rubber. In addition to the elastomer and the resistive material, a peroxide vulcanization catalyst is also present in the admixture. The resulting mixture, after thorough admixing of the components of the system, is cured at a temperature of 75° C. in a dry oven for a period of 1 hour. The resulting flexible resistor is then cut into samples which are approximately 4" in diameter and 3/32" thick. When this sample is subjected to a resistive test in a manner similar to that set forth in the above examples, it will be found that the resistance of the elastomer will be directly proportional to the resistance of the semiconducting carbonaceous pyropolymeric inorganic refractory oxide material.

In like manner, when a semiconducting carbonaceous pyropolymeric inorganic refractory oxide material is prepared by treating silica with benzene in a nitrogen atmosphere and a temperature of 850° C., is admixed with other elastomers such as methyl rubbers, butyl rubbers, etc., the resulting flexible resistor in the form of the rubber containing particles of the semiconducting carbonaceous pyropolymeric inorganic refractory oxide material and the resulting mixture cured to form specific shapes, it will be found that the resistivity of the flexible resistor will be directly proportional to the resistivity of the semiconducting carbonaceous pyropolymeric inorganic refractory oxide material which is admixed with the rubber.

I claim as my invention:

1. A pressure-sensitive flexible resistor consisting essentially of an elastomeric material impregnated with a semiconducting material in an amount of from about 5 to about 100 parts per 100 parts of elastomeric material, said semiconducting material having a resistivity at room temperature of from about $10^{-2}$ to about $10^{8}$ ohm-centimeters and consisting essentially of an inorganic refractory oxide selected from the group consisting of alumina, gamma alumina, silica, and silica-alumina having a surface area of about 25 to about 500 square meters per gram and having on the surface thereof at least a monolayer of a carbonaceous pyropolymer.

2. The pressure-sensitive flexible resistor set forth in claim 1 in which said elastomeric material is a rubber.

3. The pressure-sensitive flexible resistor set forth in claim 2 in which said rubber is a silicone rubber.

4. The pressure-sensitive flexible resistor set forth in claim 2 in which said rubber is Buna-S.

5. The pressure-sensitive flexible resistor set forth in claim 2 in which said rubber is a methyl rubber.

6. The pressure-sensitive flexible resistor set forth in claim 2 in which said rubber is a butyl rubber.

* * * * *